United States Patent [19]

Gallusser et al.

[11] 4,389,081

[45] Jun. 21, 1983

[54] ELECTRICAL CONNECTOR COUPLING RING

[75] Inventors: David O. Gallusser, Oneonta; Valentine J. Hemmer, Sidney; Gary C. Toombs, Oneonta, all of N.Y.

[73] Assignee: The Bendix Corporation, Southfield, Mich.

[21] Appl. No.: 206,793

[22] Filed: Nov. 14, 1980

[51] Int. Cl.[3] ..... H01R 13/62

[52] U.S. Cl. ..... 339/89 M; 339/89 R

[58] Field of Search ..... 339/DIG. 2, 89, 90, 339/187–190

[56] References Cited

U.S. PATENT DOCUMENTS 3,613,047 10/1971 Kron et al. ..... 339/89 R
3,805,379 4/1974 Vetter ..... 29/629
3,901,574 8/1975 Paullus et al. ..... 339/90 R
4,059,324 11/1977 Snyder et al. ..... 339/89 M
4,074,927 2/1978 Ball ..... 339/89 M

*Primary Examiner*—John McQuade
*Attorney, Agent, or Firm*—Raymond J. Eifler

[57] ABSTRACT

A coupling ring 10 for connecting together two halves of an electrical connector assembly includes means integral with the coupling ring for mounting the coupling ring 10 to a connector housing 20. The integral mounting means includes a plurality of resiliently deflectable fingers 11, each having an annular shoulder 12 thereon that mates with a groove 21 in the connector housing so that the coupling ring 10 may be rotatably mounted to a housing 20 of an electrical connector. A skirt 14, integral with the coupling ring 10 protects the fingers 11.

7 Claims, 4 Drawing Figures

ELECTRICAL CONNECTOR COUPLING RING

The invention relates to a coupling ring for an electrical connector.

Electrical connector assemblies are generally comprised of two separate housings, each having contacts mateable with contacts in the other when the housings are connected together by a coupling member. The coupling member is generally mounted to one of the housings by one or more snap rings to captivate a flange of the coupling ring against a shoulder of the housing. Accordingly, additional members have been necessary to mount the coupling ring to a housing. Examples of such connector assemblies may be found in U.S. Pat. Nos. 4,074,927 issued Feb. 21, 1978 and entitled "Electrical Connector with Insert Member Retaining Means"; and 3,805,379 issued Apr. 23, 1974 and entitled "Method of Assembling An Electrical Connector to Effect a Preloading Thereof".

DISCLOSURE OF THE INVENTION

The invention is a one piece coupling member for a connector assembly that includes novel means for mounting the coupling member to the housing. An electrical connector employing the invention is characterized by a coupling member having one or more rearwardly extending fingers that are integral with the coupling nut. Each of the fingers mates with a groove in the housing so that the coupling nut may be mounted and dismounted to the housing by deflecting the fingers outwardly.

One advantage of the invention is that it reduces the number of parts necessary to mount a coupling member to an electrical connector housing.

Another advantage of the invention is the reduction in the assembly time necessary to mount the coupling ring to a connector.

Another advantage is the simplicity by which the coupling nut may be mounted to a connector housing and, alternately remove from a connector housing.

DETAILED DESCRIPTION OF THE INVENTION

Figure 1:
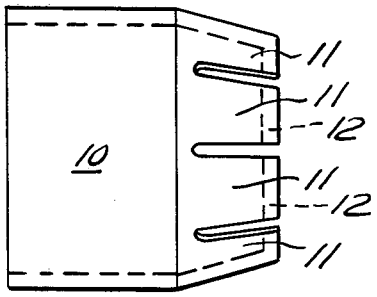
FIG. 1 is a side view of a coupling member.

Referring now to the drawings, FIG. 1 illustrates a coupling member 10 utilizing the principles of this invention. At one end of the coupling member 10, there are a plurality of inwardly and rearwardly extending fingers 11 each having on the inside thereof, an inwardly extending shoulder 12. At the other end of the coupling member, and on the inside thereof, there may be threads or a groove for receiving a bayonet pin to connect the coupling member to another housing to complete the electrical connector assembly.

Figure 2:
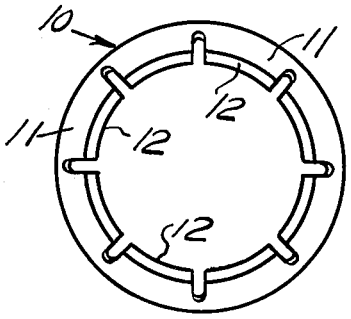
FIG. 2 is an end view of the coupling member shown in FIG. 1.

FIG. 2 illustrates the shoulders 12 that extend inwardly from the end portion of each of the fingers 11. In the preferred embodiment, the coupling ring is comprised of a plastic material such as Torlon (polyamide-imide) and therefore each of the fingers 11 are resiliently and radially deflectable.

Figure 3:
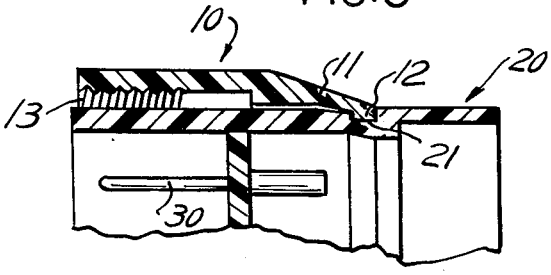
FIG. 3 illustrates a coupling member mounted on a connector housing.

FIG. 3 shows the coupling ring 10 mounted to a connector housing 20 of the type having a plurality of electrical contacts 30 mounted therein. In this embodiment, the coupling ring 10 has threads 13 on the forward portion thereof to mate with threads on another connector housing (not shown). The connector housing 20 has a annular groove 21 which receives the inwardly extending shoulders 12 at the end of the deflectable fingers 11. To mount the coupling ring 10 on the housing 20, the fingers 11 are deflected outwardly until the shoulders 12 drop into the housing groove 21. Once the shoulders 12 are in the annular groove 21, the coupling ring 10 is rotatably mounted to the housing 20. To remove the coupling ring from the housing 20, the fingers are simply deflected so that the shoulders 12 are outside of the groove 21.

Figure 4:
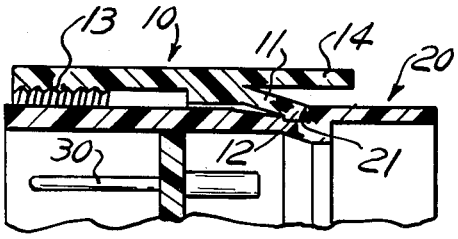
FIG. 4 illustrates an alternate embodiment of the coupling member shown in FIGS. 1, 2 and 3.

FIG. 4 illustrates an alternate embodiment of the invention wherein the coupling ring 10, mounted on the housing 20 includes an annular skirt or shroud 14 which surrounds the fingers 11. The skirt 14 therefore will protect the fingers 11 from damage e.g. handling of the coupling ring before it is mounted on the connector and once mounted on the connector protects the fingers 11 from any forces that might otherwise damage them.

While a preferred embodiment of the invention has been disclosed, it will be apparent to those skilled in the art that changes may be made to the invention as set forth in the appended claims and, in some instances, certain features of the invention may be used to advantage without corresponding use of other features. For example, the coupling ring might be rectangular and may not necessarily include the protective shroud 14 that surrounds the fingers 11. Accordingly, it is intended that the illustrative and descriptive materials herein, be used to illustrate the principals of the invention and not to limit the scope thereof.

Having described the invention what is claimed is:

1. In combination with an electrical connector of the type having: a housing having a central axis, a forward portion, a rear portion and a groove in said rear portion; at least one electrical contact mounted in said housing; and a tubular coupling member mounted to and disposed around a portion of said housing, said coupling member having a rear portion and a forward portion adapted to connect to a similar housing having at least one contact adapted to mate with said contact in said housing, the rear portion of said coupling member having: at least one inwardly and rearwardly extending finger, each finger resiliently and radially deflectable outwardly from the central axis of said housing, each finger also having an inwardly extending shoulder located in the groove in said rear portion of said housing, the improvement wherein:

said coupling member is an integral one piece molded tubular body comprised of plastic and includes a tubular portion at the rear of the coupling member that extends over each finger whereby each finger to at least the free end thereof is protected.

2. The connector as recited in claim 1 wherein said coupling member includes a plurality of rearwardly extending fingers each having an inwardly extending shoulder located in the groove in said housing.

3. In combination with an electrical connector of the type having: a cylindrical housing having a central axis, a forward portion, a rear portion and an annular groove in said rear portion; a plurality of electrical contacts mounted in said housing, each of said contacts having a forwardly facing mating portion; and a coupling ring mounted to and telescoped over a portion of said housing, said coupling ring having a rear portion and a forward portion adapted to connect to a similar housing having contacts that are adapted to mate with said contacts in said housing, the rear portion of said coupling ring has at least one rearwardly extending finger, each finger resiliently and radially deflectable outwardly from the central axis of said housing, each finger also having an inwardly extending shoulder located in the groove in said rear portion of said housing, the improvement wherein:

said coupling ring is an integral one piece molded tubular body comprised of plastic and includes an annular portion at the rear of the coupling ring that extends over each said finger whereby each finger to at least the free end thereof is protected.

4. The connector as recited in claim 3 wherein said coupling ring includes a plurality of rearwardly and extending fingers each having an inwardly extending shoulder located in the groove in said housing.

5. A one piece coupling ring for use in connecting together an electrical connector assembly, said coupling ring comprising:

a one piece molded tubular body having a central axis, a front portion and a rear portion; and at least one finger extending rearwardly from the rear portion of said tubular body, each finger resiliently and radially deflectable outwardly from the central axis of said tubular body, each finger having an inwardly extending shoulder at the end portion thereof;

means for connecting said coupling ring to an electrical connector, said means located in the front portion of the tubular body; and an annular skirt, integral with said tubular body that extends over each finger to at least the free end thereof.

6. The coupling ring recited in claim 5 wherein there are a plurality of fingers.

7. The coupling ring as recitation claim 5 or 6 wherein the ring is comprised of plastic.

* * * * *